United States Patent [19]

Diederich

[11] Patent Number: 4,877,553

[45] Date of Patent: Oct. 31, 1989

[54] GAS MANTLE TECHNOLOGY

[75] Inventor: Walter J. Diederich, West Newbury, Mass.

[73] Assignee: TPV Energy Systems, Inc., Waltham, Mass.

[21] Appl. No.: 203,312

[22] Filed: Jun. 6, 1988

[51] Int. Cl.[4] ..... F21H 1/02

[52] U.S. Cl. ..... 252/492; 431/100

[58] Field of Search ..... 252/492; 431/100

[56] References Cited

U.S. PATENT DOCUMENTS

| | | | |
|---|---|---|---|
| 359,524 | 3/1887 | Welsbach | 252/492 |
| 403,803 | 5/1889 | Welsbach | 252/492 |
| 438,125 | 10/1890 | Welsbach | 252/492 |
| 563,524 | 7/1896 | Welsbach | 252/492 |
| 568,780 | 10/1896 | Lowenberg | 252/492 |
| 574,862 | 1/1897 | Van Deth | 252/492 |
| 575,261 | 1/1897 | Moscheles | 252/492 |
| 588,685 | 8/1897 | Mahler | 252/492 |
| 589,393 | 8/1897 | Moscheles | 252/492 |
| 599,018 | 2/1898 | Simonini | 252/492 |
| 614,555 | 11/1898 | Killing | 252/492 |
| 683,981 | 10/1901 | Plaissetty | 252/492 |
| 3,640,887 | 2/1972 | Anderson | 252/301.1 |
| 4,533,317 | 8/1985 | Addison | 431/100 |
| 4,584,426 | 4/1986 | Nelson | 431/100 |

FOREIGN PATENT DOCUMENTS

| | | | |
|---|---|---|---|
| 16925 | 9/1895 | United Kingdom | 252/492 |
| 3262 | 5/1896 | United Kingdom | 252/492 |
| 160040 | 3/1921 | United Kingdom | 252/492 |

OTHER PUBLICATIONS

Martin, *The Rare Earth Industry,* Crosby, Lockwood and Son, London, (1918) pp. 14–29.

Ives, et al., "A Physical Study of the Welsbach Mantle", *Journal of the Franklin Institute,* vol. 186, (Oct. and Nov. 1918).

Kremers, *Encyclopedia of Chemical Technology,* "Gas Mantles" (1952) vol. 8, pp. 192–197.

Durand, "Performance Characteristics of High Temperature Gas-Fired Mantle Systems", Technical Report AFATL-TR-69115, pp. 1–39 (1969).

Guazzoni, "High Temperature Spectral Emittance of Oxides of Erbium, Samarium, Neodymium and Ytterbium", *Applied Spectroscopy* vol. 26, No. 1, pp. 60–65, (1972).

Guazzoni et al., "Cylindrical Erbium Oxide Radiator Structures for Thermophotovoltaic Generators", R & D Technical Report ECOM-4249, pp. 1–27, (1974).

*Primary Examiner*—Carl F. Dees

[57] ABSTRACT

A gas mantle has an operating color temperature of about 2300K and consists essentially of from about one percent to ten percent by weight of ceria and from about ninety percent to ninety-nine percent by weight of erbia.

18 Claims, 2 Drawing Sheets

GAS MANTLE TECHNOLOGY

This invention relates to gas mantle technology and more particularly to mantle structures for use with fuel burning devices such as portable fuel-burning devices to provide visible radiation.

Incandescent gas mantles were products of major commercial importance in the latter part of the nineteenth century and into the early part of the twentieth century. Early mantles, made of oxides of calcium, magnesium, zirconium, lanthanum, yttrium and the like, provided inadequate lighting power. Thorium oxide-cerium oxide mantles (with minor additives) became the standard for gas light illumination. Those mantles, however, have poor strength and durability, and also involve problems in both manufacturing and use. Thorium compounds are radioactive and require special handling precautions which makes those manufacturing procedures complex, difficult and costly. Also, those mantles are relatively fragile after they have been fired. Thoria mantles of greater strength and durability have recently been described, as has an yttrium oxide-cerium oxide mantle which is alleged to retain its mechanical strength better than commercial thoria mantles.

In accordance with one aspect of the invention, there is provided an improved gas mantle structure comprising a self-supporting erbia-ceria structure that has golden white color (a color temperature of about 2300° K.) when energized. The erbia-ceria structure preferably contains from about one percent to ten percent by weight of cerium oxide and preferably has a shock resistance figure of merit of at least three g-meters. In a particular embodiment, the mantle structure is composed of erbia-ceria filaments that are five–ten micrometers in diameter and that include a significant number of grains of dimensions in the order of one to two micrometers. The mantle structures are efficient in converting thermal energy to radiation energy in the visible spectrum (radiation in the 400–700 nanometer range).

In preferred mantles, the erbia-ceria structure is fabric-like, for example, in woven, braided, or knitted form, and formed so as to provide a self-supporting dome of erbia-ceria filaments which is heated to incandescence by a gas flame. This dome of erbia-ceria filaments can be distorted to a large degree by an external force; in such distortion the filaments bend or twist elastically, and when the force is removed they regain their original shape, restoring the initial configuration of the mantle. Mantles in accordance with this aspect of the invention are able to undergo large elastic distortions without fracture.

Mantle shock resistance depends upon such factors as mantle size and shape, characteristics of the precursor substrate used in manufacture (such as yarn size, type of weave, open area), processing conditions and mantle support. A useful shock resistance figure of merit for a cantilever supported mantle whose length and diameter dimensions are similar is provided, to a first order approximation, by the product of the shock load (in g's) that the mantle withstands and the unsupported length (in meters) of the mantle. The shock load is the force experienced by the unsupported mantle as a consequence of rapid deceleration on impact of the support tube against a stop; this load is commonly expressed in g's, where g is the acceleration due to gravity. Impact loads can involve deceleration forces substantially in excess of the force of gravity. Mantle structures in accordance with this aspect of the invention preferably have a shock resistance figure of merit of at least three g-meters.

The choice of processing conditions depends on the shape and chemical composition of the organic fabric and on the cerium and erbium compounds employed in the embodiment. A preferred organic material for use in producing mantles of the invention is low-twist rayon yarn. However, other materials that absorb adequate amounts of the imbibing solution and that thermally decompose without melting, such as cotton, wool, silk and certain synthetic materials may also be used.

Preferred erbium and cerium compounds are nitrates. The erbium and cerium compounds can be imbibed into the organic material (uniformly distributed within the fibrils) by any of several methods. In particular processes, the fabric is imbibed in an aqueous solution of nitrate salts that have a molar concentration of less than 1.4, preferably in the range of 0.8–1.1 molar, particular compositions containing erbium nitrate and cerium nitrate in concentrations such that the final sintered product contains ceria in the amount of 3.0–4.0 weight percent. Minor amounts of other materials may also be included.

The elementary erbia-ceria fibers of preferred mantles have a cross section dimension of less than ten micrometers and the mantle fabric has open area of greater than fifty percent. In a dome configuration that defines a volume of about 0.1 cubic centimeter and with a skirt portion shrink secured to a heat resistant support tube, the mantle withstands shock loads in excess of 600 g's.

In preferred embodiments, the mantle filaments contain erbium oxide in an amount in the range from 90 percent to 99 percent by weight (more preferably in the range from 96 percent to 97 percent by weight); and the mantle filaments contain cerium oxide in an amount in the range from one percent to ten percent by weight (more preferably in the range from three percent to four percent by weight). The metal oxide filaments of such a mantle, after heating in an isobutane flame, have a microstructure including a significant number of grains of dimensions in the order of one to two micrometers, and are efficient in converting thermal energy to luminous energy in the visible spectrum. The flexibility, or ability of the mantle fabric to undergo considerable elastic distortion without fracture, is evidence of the strength of this improved mantle.

In accordance with another aspect of the invention, there is provided a gas mantle manufacturing process that includes steps of imbibing a fabric of organic material with nonradioactive erbium and cerium nitrate compounds, increasing the temperature of the imbibed organic fabric in a controlled atmosphere at a controlled rate to a temperature sufficiently high to thermally decompose the erbium and cerium nitrate compounds as a step in the conversion of the erbium and cerium nitrate compounds to erbia and ceria, the erbium and cerium nitrate compounds and organic substrate material having interaction characteristics such that (in a suitable processing sequence in accordance with the invention) the erbium and cerium nitrate compounds undergo thermal conversion to a skeletal replica (with healable fissures or rifts) before thermal decomposition of the organic material is completed; further heating the imbibed fabric to decompose and remove the organic material from the imbibed fabric (the resulting further gaseous decomposition products of the organic substrate being removed from the replica through the rifts)

and to complete the conversion of the erbium and cerium nitrate compounds to erbia and ceria such that an erbia-ceria replica of the organic fabric remains; and further heating the erbia-ceria replica to sinter and densify the erbia-ceria replica such that the densified erbia-ceria replica that has a strength (shock resistance figure of merit of at least three g-meters, which strength is retained after the erbia-ceria replica has been heated to 1500° C.

In a particular process, an imbibing mixture is made by dissolving nonradioactive nitrates of erbium and cerium in distilled water and mixing the salt solutions. An organic multifiber fabric in the form of a tubular sleeve is immersed in the imbibing mixture and gently agitated to promote penetration of the imbibing solution into the organic fibers. After imbibition, the sleeve is removed from the solution and compressed and then centrifuged to remove surface liquid, tied off and formed into a mantle sock, and dried. The shiny white imbibed mantle sock fabric is then thermally processed under controlled conditions. Initially, the temperature of the fabric is gradually increased in an atmosphere that contains a reduced amount of oxygen (preferably an oxygen partial pressure of less than 100 mmHg). A quite vigorous reaction, which occurs when the mantle fabric has reached a temperature of 130°–170° C., involves an interaction (termed herein "nitrate burn") between the nitrates and the cellulosic fabric, which reaction is visually evidenced by a color change that starts at some location in the fabric and produces a front which separates a tan color from the shiny white color and advances through the fabric in a few seconds. This "nitrate burn" reaction involves a partial oxidation of the cellulose of the fabric by the decomposition products of the nitrate ions—the gases produced by the thermal decomposition of the nitrates being strongly oxidizing in reacting with the cellulose. The fabric is then further processed in an atmosphere containing an increased amount of oxygen (for example, in a heat soak interval at about 300° C.) during which the remaining cellulose is pyrolyzed and the residual carbon is removed by oxidation. During this continued thermal processing, an intermediate compound, $ErO(NO_2)_2$, if present, is transformed to $Er_2O_3$; the gas evolution slows, but continues until the replica is essentially erbium oxide, with a minor amount of cerium oxide. The temperature is further increased to densify and sinter the erbia-ceria replica. Beneficial sintering and densification of the erbia-ceria replica continues to occur until temperatures of at least about 1500° C. are reached. The resulting erbia-ceria mantle has substantial strength and light output in the visible spectrum.

Erbia-ceria mantles of the invention, in visual appearance, retain characteristic physical shapes of their organic precursors, although they are substantially reduced in dimension. Those erbia-ceria structures are characterized by relatively high density, strength (preferably a shock resistance figure of merit of at least three g-meters) and flexibility, and in preferred mantle configurations are efficient radiation sources (a luminous efficiency of at least one-half lumen per watt and an output of at least ten lumens with a one gram per hour isobutane flow rate).

Other features and advantages of the invention will be seen as the following description of particular embodiments progresses, in conjunction with the drawing, in which.

DESCRIPTION OF PARTICULAR EMBODIMENTS

Figure 1A:
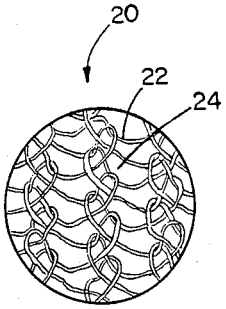
FIG. 1A is an enlarged portion of the mantle shown in FIG. 1.
Figure 1:
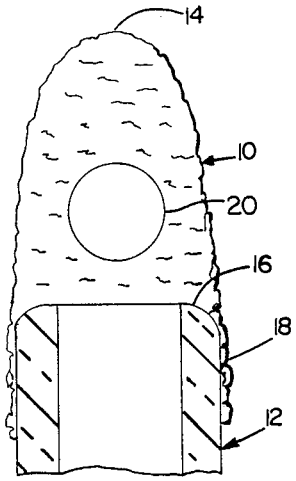
FIG. 1 is a diagrammatic sectional view of a mantle in accordance with the invention.

Shown in FIG. 1 is mantle 10 and its support tube 12 as viewed in section through the axis of tube 12. Support tube 12 is of mullite and has a length of about twenty five millimeters, an outer diameter of about five millimeters and an inner diameter about three millimeters. Mantle 10 is self-supporting erbia-ceria fabric structure that defines a hollow chamber of about seventy cubic millimeters volume with its tip 14 extending about one-half centimeter beyond the end 16 of support tube 12. The skirt 18 of the mantle fabric (about one-half centimeter in length) is firmly secured to the outer surface of support tube 12. The shape of the outer surface of support tube 12 may be varied to achieve desired mantle configurations, for example, a fluted mantle sidewall shape. Auxiliary means such as an inorganic cement or a annular recess can optionally used to enhance the securing of mantle 10 to tube 12.

The mantle fabric, a portion of which is shown enlarged generally at 20 in FIG. 1A, is formed of erbia-ceria multifilament strands 22 in an open knit array with openings 24 such that the open area of the fabric is about sixty percent. Cross-sectional dimensions of the individual fibers of strands 22 are in the range of 5–10 micrometers and the strands 22 have cross-sectional dimensions in the order of about 0.1 millimeter with openings 24 having dimensions of about one-half millimeter.

The erbia-ceria mantle 10 can be made generally as follows. An imbibing mixture is made by dissolving salts of erbium and cerium in distilled water and mixing the salt solutions. Multifibril organic yarn fabric in the form of tubular sleeves are immersed in the imbibing mixture at room temperature and gently agitated to promote penetration of the imbibing solution into the organic fibers. After imbibition the sleeves are removed from the solution and compressed and then centrifuged to remove surface liquid. The resulting damp imbibed sleeves are tied at one end to form mantle socks and the formed socks are dried in a flow of warm air and then hung on a support for firing. A firing process converts the cellulosic mantle socks imbibed with erbium and cerium compounds into mechanically strong mantles that are composed substantially entirely of erbia and ceria and that emit radiation in the visible spectrum.

EXAMPLE 1

Knit-braided rayon hose (14 needle, 150 denier/60 filament) was soaked for ten minutes at room temperature in an aqueous imbibing mixture containing 0.952M $Er(NO_3)_3$ and 0.048M $Ce(NO_3)_3$, made by mixing ten cubic centimeters of a 1.0M solution of reagent grade hydrated erbium nitrate ($Er(NO_3)_3.4H_2O$) and 0.5 cubic centimeters of a 1.0M solution of reagent grade hydrated cerium nitrate ($Ce(NO_3)_3.6H_2O$). The imbibed hose was pressed and then centrifuged for about ten minutes at about 200 g's to remove excess liquid.

Lengths of the damp imbibed hose were then formed into mantle socks by tying, shaping on a preform and drying using a flow of warm air (about 90° C.), and then placed on a fixture comprising a series of upstanding mullite posts spaced at intervals of about three centimeters on a mullite base. Each mullite post was about three millimeters in diameter and about 3.7 centimeters long and receives a support tube and spacer, the top of each support tube being spaced about five millimeters below the top of the post. Optionally a ring of sodium silicate that has been pretreated by heating the tube to about 300° C. can be carried by the tube.

The fixture with knitted imbibed formed socks hung over the support tubes on the posts was then subjected to a firing procedure to convert the erbium nitrate and cerium nitrate imbibed cellulosic mantle socks into light emitting and mechanically strong mantles.

Figure 2:
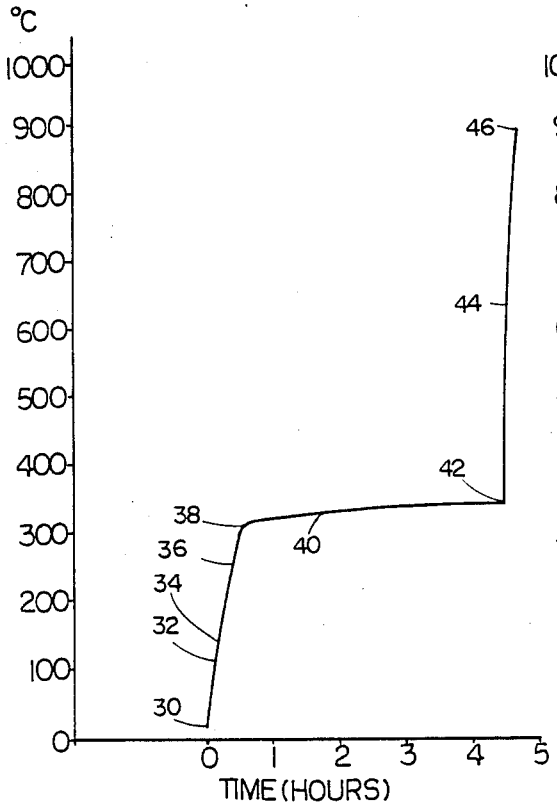
FIGS. 2 and 3 are graphs showing particular processing sequences for producing mantles in accordance with the invention.

In the processing sequence diagrammed in FIG. 2, the fixture with the socks was placed in a fifty-two millimeter inner diameter quartz tube furnace (Thermolyne Model F-21125). At ambient temperature (about 20° C.; indicated at point 30 in FIG. 2), carbon dioxide at a flow rate of sixty cubic centimeters per minute was flowed through the furnace. With this atmosphere in the furnace, the furnace temperature was then increased at a rate of 8.9° C. per minute as indicated at line 32. The mantle fabric underwent "nitrate burn" at about 136° C. (point 34). At this point the fabric color changed rapidly from white to golden tan. Heating was continued at a rate of about 7.8° C. per minute as indicated by line 36 to a temperature of about 300° C. (point 38). During this time the color continuously changed from golden tan to dark brown or black with modest shrinkage (about 10%) of the fabric, indicating additional decomposition of the organic material. Air at a flow rate about 250 cubic centimeters per minute was then flowed through the furnace while the temperature was being raised at about 0.4° C. per minute, as indicated at line 40, to about 340° C., where the furnace temperature was held for about two hours sufficient to permit the mantles to turn from black to light gray or white. During this soaking interval in air the remaining carbon was oxidized and driven off and each dimension of the mantle shrank to about one-third of its original dimension so that the skirt portion was shrunk onto its support tube. At the end of the soaking interval (point 42) the furnace temperature was increased rapidly, at 37° C. per minute, as indicated at line 44, to a temperature of about 900° C. (point 46). The furnace heater was then turned off and the furnace allowed to cool to ambient temperature.

After cooling, each mantle subassembly was removed from its post and exposed to a burning mixture of isobutane and air at an estimated temperature of about 1600° C. for five minutes to further shrink and densify the metal oxide fabric.

Mantles 10 formed and shrink fitted to support tubes 12 in this manner were evaluated for shock strength using a L A B Automatic Drop Shock Tester (Model SD-10-66-30, available from Material Technology Incorporated) which is used with a Type 5520.5.85 Decelerating Device (pulse pad) for shock loads of up to about 600 g's and with a Type 5520.5.28 Decelerating Device (pulse pad) for shock loads in the range of 600 g's to 1600 g's. Mantles, made as described in this example, survived drop tests at shock loads in excess of 900 g's (range 900–1150 g's) and, when activated with an isobutane flame, yielded luminous efficiencies of about 0.9 lumens/watt (range 0.86–0.99 lumens/watt) at a color temperature of about 2265° K. (range 2220°–2340° K.).

EXAMPLE 2

In this example, knit-braided hose was imbibed, and imbibed socks were shaped, dried, and hung on a fixture as described above for Example 1. Then the socks were subjected to a firing procedure as follows.

Figure 3:
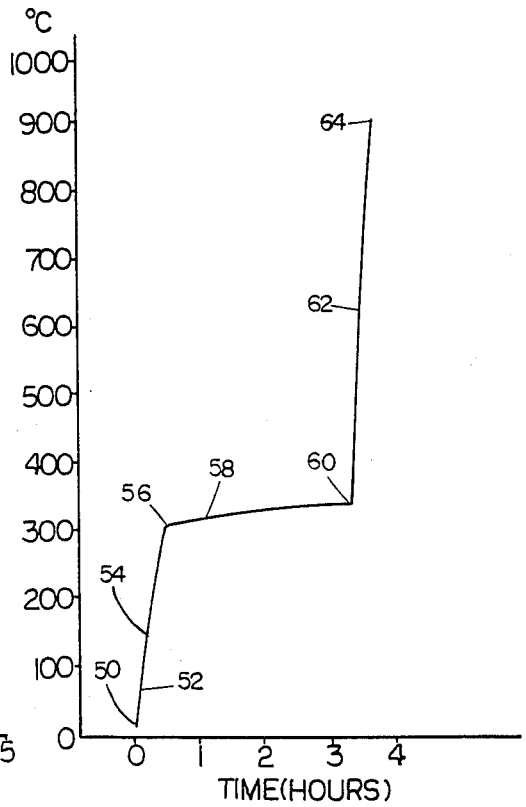

In the processing sequence diagrammed in FIG. 3, the fixture with the socks was placed in the quartz tube furnace. At ambient temperature (about 20° C.; indicated at point 50 in FIG. 3), a mixture of air at a flow rate of fifty cubic centimeters per minute and carbon dioxide at a flow rate of sixty cubic centimeters per minute (the mixture containing about 9% $O_2$). This flow was continued as the furnace temperature was increased at a rate of 11.3° C. per minute as indicated at line 52. The mantle fabric undergoes a nitrate burn at about 136° C. (point 54). At this point the fabric color changes rapidly from white to golden tan. Heating was continued at a rate of about 9.5° C. per minute to a temperature of about 300° C. (point 56). During this time the color continuously changed from golden tan to dark brown or black with modest shrinkage (about 10%) of the fabric, indicating additional decomposition of the organic material. Air was then flowed through the furnace at a rate about 250 cubic centimeters per minute as the temperature was raised at about 0.4° C. per minute, as indicated at line 58, to about 340° C., so that it was held in the range 300° C.–340° C. for a time (about two hours) sufficient to permit the mantles to turn from black to light gray or white. During this soaking interval in air, the remaining carbon was oxidized and driven off and each dimension of the mantle shrank to about $\frac{1}{3}$ its original value so that its skirt portion was shrunk onto the support tube. At the end of the soaking interval (point 60) the furnace temperature was increased rapidly, at 37° C. per minute, as indicated at line 62, to a temperature of about 900° C. (point 64). The furnace heater was then turned off and the furnace allowed to cool to ambient temperature.

After cooling, each mantle subassembly 10, 12 was removed from its post and exposed to a burning mixture of isobutane and air at an estimated temperature of about 1600° C. for five minutes to further shrink and densify the metal oxide fabric.

Mantles 10 formed and shrink fitted to support tubes 12 in this manner were evaluated for shock strength as described above for Example 1. Mantles made as described in this example produced a luminous efficiency activated with isobutane at ten scc of about one lumen/watt (range 0.96–1.01 lumens/watt) at a color temperature of about 2250° K. (range 2230°–2360° K.), and survived drop tests at shock loads in excess of about 1000 g's (range 750–1350 g's).

FURTHER EXAMPLES

Further erbia-ceria mantles according to the invention were made using imbibing solutions having various concentrations and various molar ratios of erbium and cerium, and the mantles so made were tested for luminous efficiency and color temperature.

Erbium nitrate (99.9% pure) and cerous nitrate (A.C.S. grade) were each dissolved in distilled water at the following molar concentrations: 0.6M, 0.8M, 1.0M, 1.2M, and 1.5M. These aqueous solutions of erbium nitrate and cerous nitrate were mixed in various proportions to yield imbibing mixtures having cerium:erbium atom ratios ranging from 0.02 to 0.15. Nine different such imbibing mixtures were prepared at each molar concentration.

Lengths of braided rayon sleeves were imbibed with erbium and cerous nitrate solutions by immersing them in imbibing mixtures of aqueous erbium and cerous nitrates prepared as described above for thirty minutes and then dried and tied to form mantle socks. The dried preformed mantle socks were placed over support tubes 12 and thermally processed with a propane/air flame to provide erbia-ceria mantles 10 on support tubes 12.

Each mantle-tube assembly was operated with a constant supply of isobutane (ten scc/minute), the isobutane vapor being delivered through a 0.001 inch diameter orifice located in the throat of a venturi so that primary combustion air was entrained with the isobutane vapor. The isobutane flow rate was measured using a Hastings H-10 mass flow transducer and an ALL-10 readout. The air inlet to the venturi had an adjustable restriction so that the entrained air could be adjusted for maximum light output from the mantle.

The luminous output of each operating mantle was measured with a Model 450-1 EG&G, Inc. radiometer/-photometer, having a silicon photodiode type detector with a photopic filter. Readings were taken at distances (about 25 centimeters) from the mantle that were large compared to the mantle dimension. For purposes of calculating luminous efficiency, it was assumed that such a mantle acts like a point source (this assumption being approximately verified in an integrating sphere). The lux reading from the photometer was converted to lumens and the luminous efficiency obtained by dividing the lumen reading by the gross heat of combustion of the fuel burned. Color temperatures were measured with a Minolta Color Meter II.

The luminous efficiencies and color temperatures of mantles made using imbibing solutions over the entire range of ceria/erbia ratios were measured, and at each cerium:erbium atom ratio, mantles made using imbibing solutions at the various concentrations showed no significant differences in resulting luminous efficiency and color temperature.

Figure 4:
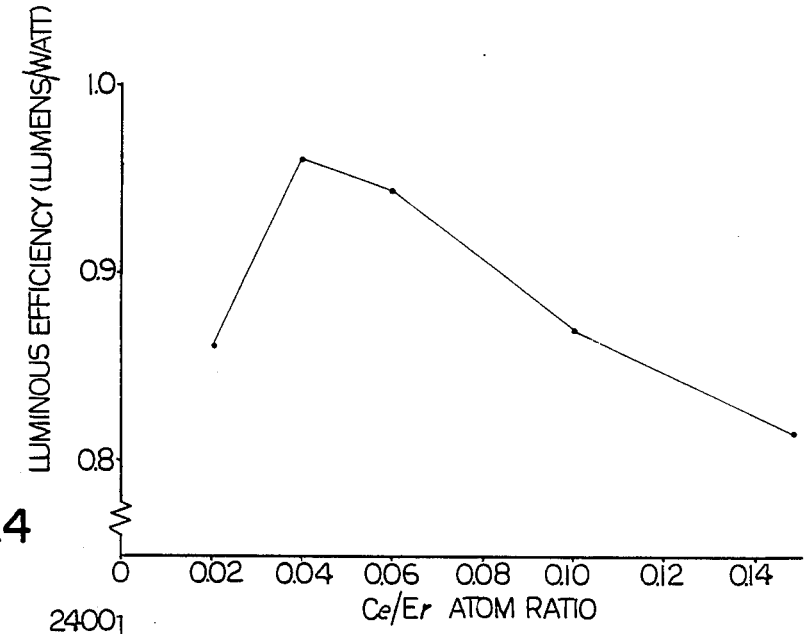
FIG. 4 is a graph of luminous efficiency as a function of Ce/Er atom ratio of mantles in accordance with the invention.
Figure 5:
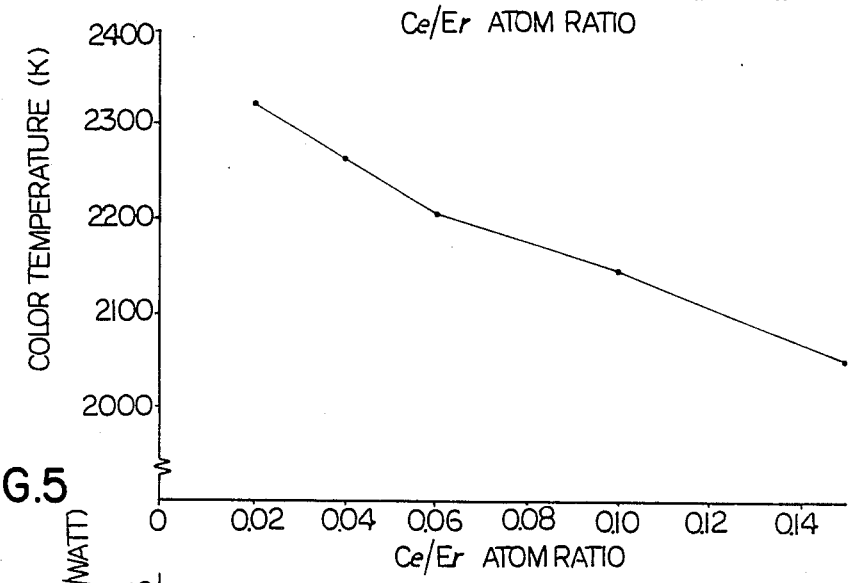
FIG. 5 is a graph of color temperature as a function of Ce/Er atom ratio of mantles in accordance with the invention.

As indicated in FIG. 4, the luminous efficiency was greatest for mantles made using a Ce:Er atom ratio of 0.04, was progressively less at ratios of 0.06, 0.1, and 0.15, and was also less at a ratio of 0.02. In the range of atom ratios tested, for mantles with an isobutane flow rate of ten scc/min, the color temperatures, as indicated in FIG. 5, was highest (about 2320° K.) for mantles made using a Ce:Er atom ratio of 0.02 and was progressively less at higher atom ratios about 2265° K. for a Ce:Er atom ratio of 0.04 to about 2050° K. for a Ce:Er atom ratio of 0.15.

Figure 6:
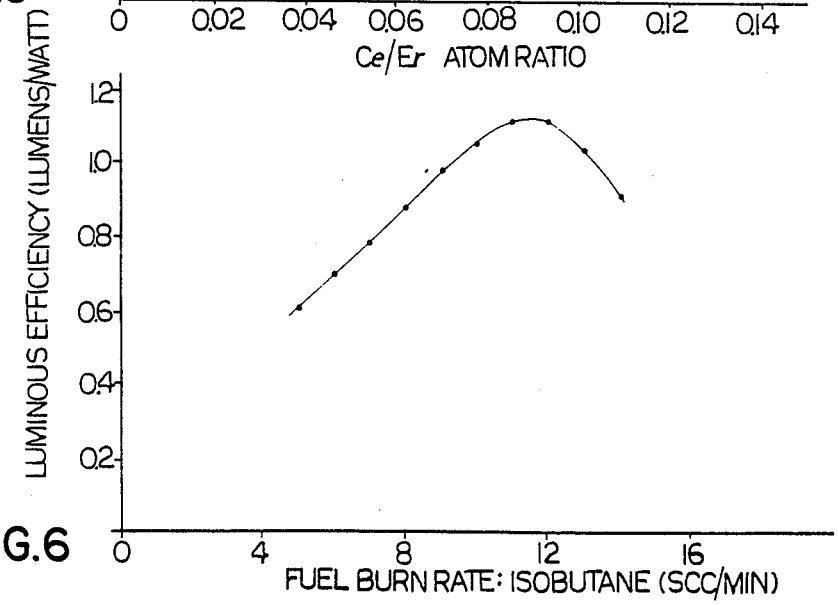
FIG. 6 is a graph of luminous efficiency as a function of fuel burn rate of mantles in accordance with the invention.

A mantle with a ceria/erbia weight ratio of about 0.035. was operated over a range of isobutane fuel burn rates from five scc/minute to fourteen scc/minute, and luminous efficiencies were measured, as indicated in FIG. 6. At lower fuel burn rates inadequate thermal energy was transferred to the luminous mantle and the mantle ran at cooler temperatures, resulting in lower luminous efficiencies. At higher fuel burn rates, the flame lifted off the mantle so that less heat was transferred to the mantle, resulting in lower luminous efficiencies. The optimum operating point was at a fuel burn rate about eleven to twelve scc/minute, where the luminous efficiency was in excess of about 1.1 lumens/-watt.

While particular embodiments of the invention have been shown and described, various modification thereof will be apparent to those skilled in the art, and therefor, it is not intended that the invention be limited to the disclosed embodiments or to details thereof, and departures may be made therefrom within the spirit and scope of the invention.

What is claimed is:

1. An improved gas mantle structure comprising a self-supporting structure consisting essentially of erbia and ceria and that has an operating color temperature of about 2300° K.

2. The mantle structure of claim 1 wherein said mantle structure contains from about one percent to ten percent by weight of ceria.

3. The mantle structure of claim 1 wherein said mantle structure has a shock resistance figure of merit of at least three g-meters.

4. The mantle structure of claim 1 wherein said mantle structure is composed of erbia-ceria filaments that include a significant number of grains of dimensions in the order of one to two micrometers.

5. The mantle structure of claim 4 wherein the elementary erbia-ceria fibers of said mantle structure have a cross section dimension of less than ten micrometers and are in the form of a fabric that has greater than fifty percent open area.

6. The mantle structure of claim 4 wherein said mantle filaments contain erbium oxide in an amount in the range from ninety percent to ninety-nine percent by weight and cerium oxide in an amount in the range from one percent to ten percent by weight.

7. The mantle structure of claim 6 wherein said mantle filaments contain erbium oxide in an amount in the range from ninety-six percent to ninety-seven percent by weight and cerium oxide in an amount in the range from three percent to four percent by weight.

8. The mantle structure of claim 1 wherein said mantle structure has a luminous efficiency of at least one-half lumen per watt and an output of at least ten lumens at a one gram per hour isobutane flow rate.

9. A process for manufacturing a gas mantle comprising the steps of imbibing a fabric of organic material with nonradioactive nitrate compounds of erbium and cerium, increasing at a controlled rate the temperature of the imbibed organic fabric to a temperature sufficiently high to thermally decompose the erbium and cerium nitrate compounds as a step in the conversion of the erbium and cerium nitrate compounds to erbia and ceria, further heating the imbibed fabric to decompose and remove the organic material from the imbibed fabric and to complete the conversion of the erbium and cerium nitrate compounds to erbia and ceria such that an erbia-ceria replica of the organic fabric remains; and further heating the erbia-ceria replica to sinter and densify the erbia-ceria replica such that a densified erbia-ceria replica that has a strength (shock resistance) figure of merit of at least three g-meters, which strength is retained after the erbia-ceria replica has been heated to 1500° C.

10. The process of claim 9 wherein said fabric is imbibed in an aqueous solution of nitrate salts that have a molar concentration of less than 1.6, and the final sintered product contains ceria in the amount of 3.0–4.0 weight percent.

11. The process of claim 9 wherein an imbibing mixture is made by dissolving nonradioactive nitrates of erbium and cerium in distilled water, said organic fabric in the form of a tubular sleeve is immersed in said imbibing mixture and gently agitated to promote penetration of the imbibing solution into the organic fibers, after removal of said sleeve from said solution, said sleeve is dried and formed into a mantle sock, and said imbibed mantle sock is then thermally processed under controlled conditions, initially, the temperature of the sock being gradually increased in an atmosphere that contains a reduced amount of oxygen to produce a nitrate burn, further heating the sock in an atmosphere containing an increased amount of oxygen during which the remaining cellulose is pyrolyzed and the residual carbon is removed by oxidation and an erbia-ceria replica of said sock is created, and further heating said replica to densify and sinter the erbia-ceria structure.

12. A gas mantle made according to the process of claim 9.

13. A gas mantle that has an operating color temperature of about 2300° K., said mantle being a self-supporting fabric-like structure and consisting essentially of from about one percent to ten percent by weight of ceria and from about ninety percent to ninety-nine percent by weight of erbia.

14. The mantle of claim 13 wherein said mantle is composed of erbia-ceria filaments that have a cross section dimension of less than ten micrometers.

15. The mantle of claim 13 wherein said mantle has a luminous efficiency of at least one-half lumen per watt and an output of at least ten lumens at a one gram per hour isobutane flow rate.

16. The mantle of claim 15 wherein said mantle has a shock resistance figure of merit of at least three g-meters and withstands shock loads in excess of 600 g's.

17. The mantle of claim 16 wherein said mantle filaments contain erbia in an amount of about ninety-seven percent by weight and ceria in an amount of about three percent by weight.

18. The mantle of claim 17 wherein said mantle is composed of erbia-ceria filaments that have a cross section dimension of less than ten micrometers.

* * * * *